US005901670A

United States Patent [19]

Moroi et al.

[11] Patent Number: 5,901,670

[45] Date of Patent: May 11, 1999

[54] VARIABLE HEAT GENERATION VISCOUS FLUID TYPE HEAT GENERATOR

[75] Inventors: Takahiro Moroi; Takashi Ban; Fumihiko Kitani; Tsutomu Sato; Hidefumi Mori; Tatsuyuki Hoshino, all of Kariya, Japan

[73] Assignee: Kabushiki Kaisha Toyoda Jidoshokki Seisakusho, Kariya, Japan

[21] Appl. No.: 09/075,687

[22] Filed: May 11, 1998

[30] Foreign Application Priority Data

May 16, 1997 [JP] Japan ..... 9-126966

[51] Int. Cl.[6] ..... F22B 3/06

[52] U.S. Cl. ..... 122/26; 126/247

[58] Field of Search ..... 122/26; 126/247; 123/142.5 R; 237/12.3 R, 12.3 B

[56] References Cited

U.S. PATENT DOCUMENTS 4,387,701 6/1983 Gibbons .

5,765,545 6/1998 Ban et al. ..... 122/26

5,799,619 9/1998 Hoshino et al. ..... 122/26

FOREIGN PATENT DOCUMENTS

JU-A-3-98107 10/1991 Japan .

*Primary Examiner*—Teresa Walberg
*Assistant Examiner*—Gregory A. Wilson
*Attorney, Agent, or Firm*—Morgan & Finnegan, L.L.P.

[57] ABSTRACT

A variable heat generating viscous fluid type heat generator having a housing assembly including movable and fixed plate members arranged to define an axially bounded region in which a heat generating chamber is formed to have an axial width which is changed by the axial movement of the movable plate member with respect to the fixed plate member within the housing assembly by the controlled operation of the moving unit. The change in the axial width of the heat generating chamber causes a change in the gap size of a fluid filled gap between the outer face of the rotor element and the inner wall surface of the heat generating chamber and, accordingly, the heat generating performance of the viscous fluid type heat generator is adjustably varied.

22 Claims, 9 Drawing Sheets

VARIABLE HEAT GENERATION VISCOUS FLUID TYPE HEAT GENERATOR

BACKGROUND OF THE INVENTION

1. Field of the Invention

The present invention relates to a variable heat generation viscous-fluid-type heat generator adapted to be used as a heat source incorporated in a heating system for heating an objective area. More particularly, the present invention relates to variable heat generating viscous fluid type heat generator adapted to be incorporated in a vehicle heating system for heating a passenger compartment of a vehicle.

2. Description of the Related Art

Japanese Unexamined (Kokai) Utility Model Publication No. 3-98107 (JU-A-3-98107) discloses a viscous fluid type heat generator adapted to be incorporated into an automobile heating system as a supplemental heat source. The viscous-fluid-type heat generator of JU-A-3-98107 is formed as a heat generator provided with a unit for changing a heat-generating performance. The heat generator of JU-A-3-98107 includes front and rear housings connected together to form a housing assembly in which a heat generating chamber for permitting a viscous fluid to generate heat, and a heat receiving chamber arranged adjacent to the heat generating chamber for permitting a heat exchanging liquid to receive the heat from the heat generating chamber, are formed. The heat receiving chamber in the housing assembly permits the heat exchanging liquid to flow therethrough from a liquid inlet port to a liquid outlet port formed in a portion of the housing assembly. Namely, the heat exchanging liquid is circulated through the heat receiving chamber and a separate heating circuit of the automobile heating system so as to supply the heat to the objective area, e.g., a passenger compartment of the automobile, during the operation of the heating system. The heat exchanging liquid flows into and out of the heat receiving chamber through the liquid inlet port and the liquid outlet port. The heat generator of JU-A-3-98107 further includes a drive shaft rotatably supported by bearings which are seated in the front and rear housings of the housing assembly. A rotor element is mounted on the drive shaft so as to be rotated together with the drive shaft within the heat generating chamber. The inner wall surface of the heat generating chamber and the outer surfaces of the rotor element define labyrinth grooves in which a viscous fluids such as silicone oil having a chain-molecular structure, is held to generate heat in response to the rotation of the rotor element.

The heat generator of JU-A-3-98107 has such a characteristic arrangement that upper and lower housings are attached to a bottom portion of the housing assembly to form a heat generation control chamber therein. The heat generation control chamber is formed as a volume-variable chamber having a wall consisting of a membrane such as a diaphragm.

The heat generating chamber communicates with the atmosphere via a through-hole bored in an upper portion of the front and rear housings of the housing assembly, and with the heat generation control chamber via a communicating channel arranged between the heat generation control chamber and the heat generating chamber. The volume of the heat generation control chamber is adjustably changed by the movement of the diaphragm which is caused by a spring element having a predetermined spring factor or an externally supplied signal such as a pressure signal supplied from an engine intake manifold of an automobile.

When the heat generator of JU-A-3-98107 is incorporated in a vehicle heating system and the drive shaft is driven by a vehicle engine the rotor element is rotated within the heat generating chamber, so that heat is generated by the viscous fluid, to which a shearing force is applied, between the inner wall surface of the heat generating chamber and the outer surface of the rotor element. The heat generated by the viscous fluid is transmitted from the heat generating chamber to the heat exchanging liquid, i.e., engine-cooling water circulating through the heat receiving chamber and through the heating system, to be carried by the water to a heating circuit of the heating system in order to warm an objective heated area such as a passenger compartment.

When heat transmitted from the vehicle heating system to the objective heated area is excessive, a vacuum is applied by the engine intake manifold to the diaphragm of the heat generation control chamber, and accordingly, the volume of the heat generation control chamber is increased due to the movement of the diaphragm. Therefore, the viscous fluid is withdrawn from the heat generating chamber into the heat generation control chamber to reduce heat generation in the viscous fluid within the heat generating chamber. Thus, the supply of heat from the viscous fluid type heat generator to the vehicle heating system is decreased to result in an reduction in the heat applied to the objective heated area.

On the other hand, when heat transmitted from the vehicle heating system to the objective heated area is too small, the diaphragm is moved by a combination of the spring force of the coil spring and the atmospheric pressure to reduce the volume of the heat generation control chamber. Therefore, the viscous fluid is supplied from the heat generation control chamber to the heat generating chamber to increase heat generation in the viscous fluid within the heat generating chamber. Thus, the supply of heat from the viscous fluid type heat generator to the vehicle heating system is increased to result in an increase in the heat applied to the objective heated area.

With the viscous fluid heat generator of JU-A-3-98107 incorporated in a vehicle heating system the heat generation control chamber is arranged below the heat generating chambers so that the viscous fluid may be withdrawn from the heat generating chamber into the heat generation control chamber due to its own weight when the heat generation by the heat generator should be reduced However, the withdrawal of the viscous fluid from the heat generating chamber into the heat generation control chamber cannot be smoothly achieved when the rotor element is being rotated within the heat generating chamber Specifically, since the heat generating chamber of the viscous fluid heat generator of JU-A-3-98107 has a labyrinth construction formed between the outer face of the rotor element and the inner wall surface of the heat generating chamber, it is very difficult for the viscous fluid to be withdrawn from the heat generating chamber into the heat generation control chamber via the labyrinth construction. Therefore, a rapid reduction in the heat generating performance of the viscous fluid type heat generator cannot be obtained Further, when the viscous fluid is withdrawn from the heat generating chamber into the heat generation control chamber, fresh air is introduced from an open port formed in the housing of the heat generator into the heat generating chamber so as to compensate for a vacuum occurring in the heat generating chamber. Thus, the viscous fluid is apt to come into contact with moisture contained in the fresh air when the reduction in the heat generating performance of the heat generator is carried out. Accordingly, the viscous fluid is rather quickly degraded by the moisture to reduce the heat generating efficiency of the viscous fluid to shorten the operating life of the viscous fluid type heat generator.

SUMMARY OF THE INVENTION

An object of the present invention is to provide a variable heat generating viscous fluid type heat generator with means for quickly and surely reducing the heat generating performance thereof without causing a reduction in the heat generating efficiency during the operating life of the heat generator.

Another object of the present invention is to provide a variable heat generating viscous fluid type heat generator suitable for being incorporated in a vehicle heating system and capable of quickly reducing heat generation in response to a requirement from the vehicle heating system.

A further object of the present invention is to provide a variable heat generating viscous fluid type heat generator capable of controlling a heat generating performance in response to an external control signal.

In accordance with the present invention, there is provided a heat generating viscous fluid type heat generator which comprises a housing assembly having therein a heat generating chamber in which heat is generated, and a heat receiving chamber arranged adjacent to the heat generating chamber to permit a heat exchanging fluid to circulate therethrough to thereby receive heat from the heat generating chamber, the heat generating chamber having an inner wall surface thereof;

a drive shaft supported by the housing assembly, via bearing means, to be rotatable about an axis of rotation thereof;

a rotor element mounted to be rotationally driven by the drive shaft for rotation together therewith within the heat generating chamber, the rotor element having an outer face confronting the inner wall surface of the heat generating chamber via a predetermined fluid filled gap;

a viscous fluid, filling the predetermined fluid filled gap between the inner wall surface of the heat generating chamber and the outer face of the rotor element, for heat generation during the rotation of the rotor element, wherein the housing assembly defines therein an axially bounded region in which the heat generating chamber is formed to have a given axial width, the housing assembly including a plate member assembly for separating the heat receiving chamber from the heat generating chamber, the inner wall surface of the heat generating chamber being provided to be displaced to adjustably change the axial width of the heat generating chamber.

The above-described variable heat generating viscous fluid type heat generator is able to adjustably change an axial width of the heat generating chamber, in which the outer face of the rotor element and the inner wall surface of the heat generating chamber define the predetermined fluid filled gap supplied with the viscous fluid such as a silicone oil, by an axial displacement of the inner wall surface of the heat generating chamber. Therefore, the gap size of the fluid filled gap may be directly and quickly adjusted by finely adjusting the axial displacement of the inner wall surface of the heat generating chamber. It should be noted that a change in the gap size of the fluid filled gaps of the heat generating chamber can cause a change in the heat generation in the viscous fluid within the fluid filled gaps in a reversely proportional relationship with the gap size change.

Further, in the variable heat generating viscous fluid type heat generator, when the fluid filled gap is increased (ice, the inner volume of the heat generating chamber is increased), so as to reduce the heat generating performance of the heat generator, a vacuum produced by the increase in the inner volume of the heat generating chamber may be compensated for by a thermal expansion of the air unavoidably contained in the heat generating chamber during the assembly of the heat generator. Thus, the viscous fluid filled in the fluid filled gap of the heat generating chamber can be prevented from coming in contact with fresh air and moisture contained in the fresh air during the long operating life of the viscous fluid type heat generator. Therefore, the degradation in the heat generating property of the viscous fluid is not accelerated by the air and moisture.

Preferably, the plate member assembly includes at least one axially movable plate member having a face forming a part of the inner wall surface of the heat generating chamber. Further, the plate member assembly further includes a fixed plate member for separating the heat receiving chamber from the heat generating chamber. Then, the axially movable plate member defines the heat generating chamber in the axially bounded region of the housing assembly.

Since the axially movable plate member of the plate member assembly is preferably arranged to perform a minute amount of axial movement to adjustably change the axial width of the heat generating chamber, a gap size of the fluid filled gap between the outer face of the rotor element and the inner wall surface of the heat generating chamber, which has a reverse proportional relationship with an amount of heat generation in the viscous fluid held within the fluid filled gap, can be directly and quickly adjusted.

Further, since the fixed plate member of the plate member assembly is arranged to separate the heat receiving chamber from the heat generating chamber, an appreciable change in an inner volume of the heat receiving chamber does not occur even if the axial width of the heat generating chamber is changed by the displacement of the movable plate member. Thus, the heat exchanging liquid flowing through the heat receiving chamber can constantly maintain a stable flowing speed. Thus, during the heat generating operation of the viscous fluid type heat generator, potential vibration and noise due to a change in the flow speed of the heat exchanging liquid can be prevented. Thus, a quiet operation of the viscous fluid type heat generator can be achieved.

Preferably, the viscous fluid type heat generator further includes a moving unit for providing the movable plate member with an axial movement to thereby adjustably change the axial width of the heat generating chamber.

Advantageously, the above-mentioned moving unit is arranged in a predetermined confined region in which the axially movable plate member axially confronts a stationary part of the housing assembly.

The predetermined confined region is preferably formed as a heat generation control chamber which should be an air-tight chamber.

The moving unit may comprise an elastic element for urging the axially movable plate member in an axial direction for reducing the axial width of the heat generating chamber, and a gas inletting means for introducing a vacuum into the air-tight heat generation control chamber in response to an external control signal The vacuum acts on the axially movable plate member to produce a force against an elastic force of the elastic element.

Alternatively, the moving unit may comprise an elastic element for providing the axially movable plate member with a constant elastic force to move the axially movable plate member in an axial direction for changing the axial width of the heat generating chamber, and a solenoid actuator which includes a magnetic core element attached to the axially movable plate member, and a solenoid arranged around the magnetic core to attract the core in response to an external control signal to thereby move the axially movable plate member against the constant elastic force of the elastic element.

The external control signal is preferably a temperature detection signal by which a necessity for the supply of heat by the heat generator is detected.

The rotor element mounted on the drive shaft within the heat generating chamber may be arranged to be freely movable along the axis of rotation of the drive shaft. Alternatively, the rotor element may be mounted on the drive shaft so as to be axially fixed to the drive shaft.

When the rotor element is axially fixed to the drive shaft, the axially movable plate member may be arranged to be elastically urged by an elastic element in an axial direction to reduce the axial width of the heat generating chamber, and at least one of the outer face of the rotor element and a face of the axially movable plate member confronting the outer face of the rotor element may comprise a fluid pressure increasing means for increasing a fluid pressure in the fluid filled gap in response to the rotation of the rotor element, in order to move the axially movable plate member against a constant elastic force of the elastic element in a direction for increasing the axial width of the heat generating chamber.

The fluid pressure increasing means preferably comprises an inclined surface formed in one of the outer face of the rotor element and the confronting face of the axially movable plate member, and providing the fluid filled gap between the rotor element and the axially movable plate member with a continuous change in a gap size, in response to the rotation of the rotor element.

Alternatively, the fluid pressure increasing means may comprise recessed portions and elevated portions alternately arranged circumferentially in at least one of the outer face of the rotor element and the confronting face of the axially movable plate member. Then, the recessed and elevated portions are formed to extend in a direction different from a circumferential direction about the drive shaft.

The housing assembly is preferably constructed to have a generally axially extending cylindrical portion to define therein a cylindrical chamber to receive the plate member assembly. The cylindrical chamber has a large open end through which the plate member assembly is assembled therein and is closed by a lid-like housing member so that the cylindrical chamber is sealed against the atmosphere.

Preferably, the variable heat generating viscous fluid type heat generator further comprises a limiting unit for limiting an axial movement of the axially movable member displaced against a stationary portion of the housing assembly. Thus, an adjustable limit of the axial width of the heat generating chamber is determined by the limiting unit.

Alternatively, the variable heat generating viscous fluid type heat generator may be constructed to have an urging unit for constantly urging the axially movable plate member of the plate member assembly to be moved in an axial direction reducing the axial width of the heat generating chamber, the urging unit being arranged in a predetermined confined region in which the axially movable plate member axially confronts a stationary part of the housing assembly. Then, the urging unit preferably comprises a coil spring arranged in the predetermined confined region.

BRIEF DESCRIPTION OF THE DRAWINGS

The above and other objects, features, and advantages of the present invention will be made more apparent from the ensuing description of the embodiments thereof with reference to the accompanying drawings wherein.

DESCRIPTION OF THE PREFERRED EMBODIMENTS

Figure 1:
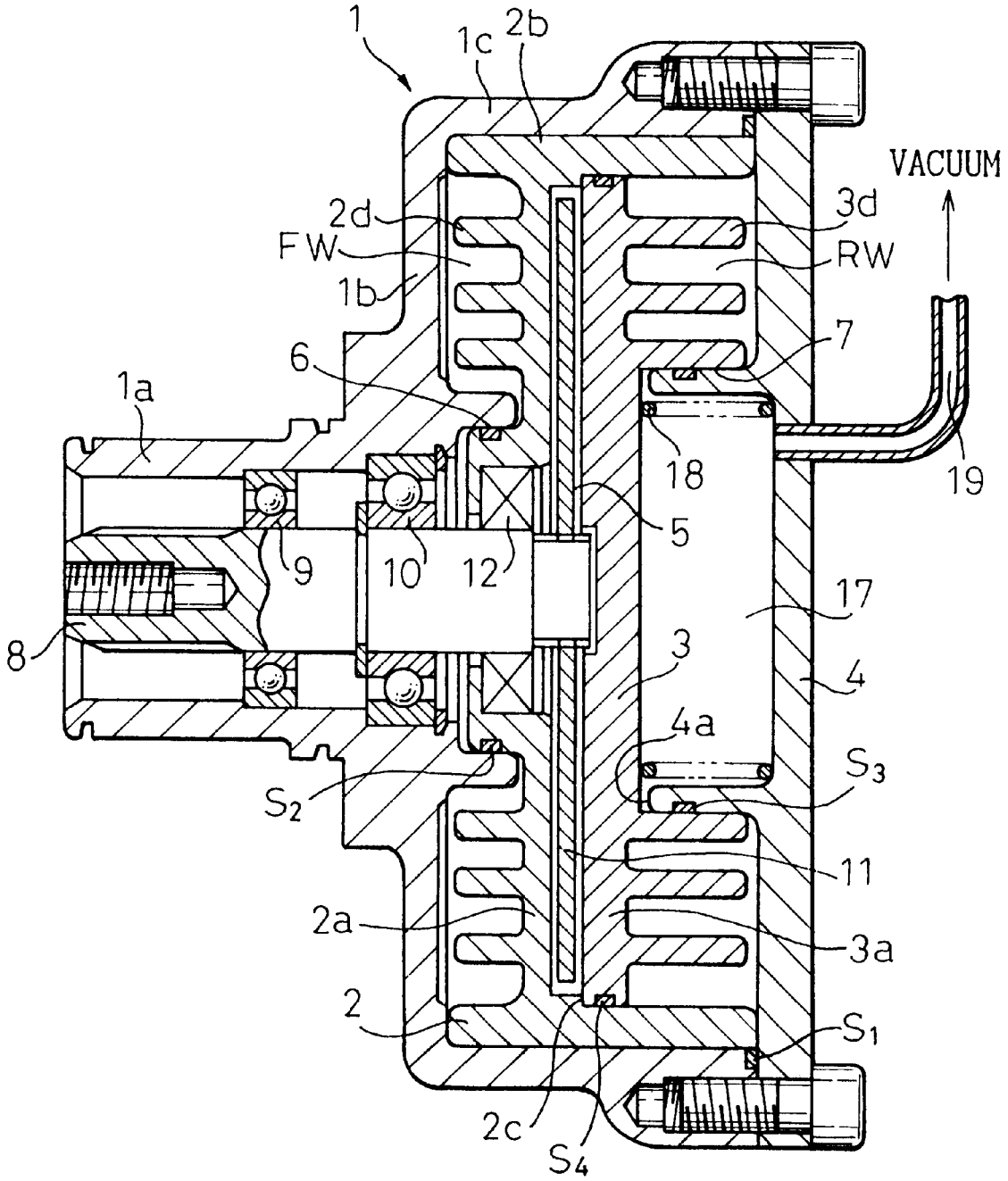
FIG. 1 is a longitudinal cross-sectional view of a variable heat generating viscous fluid type heat generator according to a first embodiment of the present invention.
Figure 2:
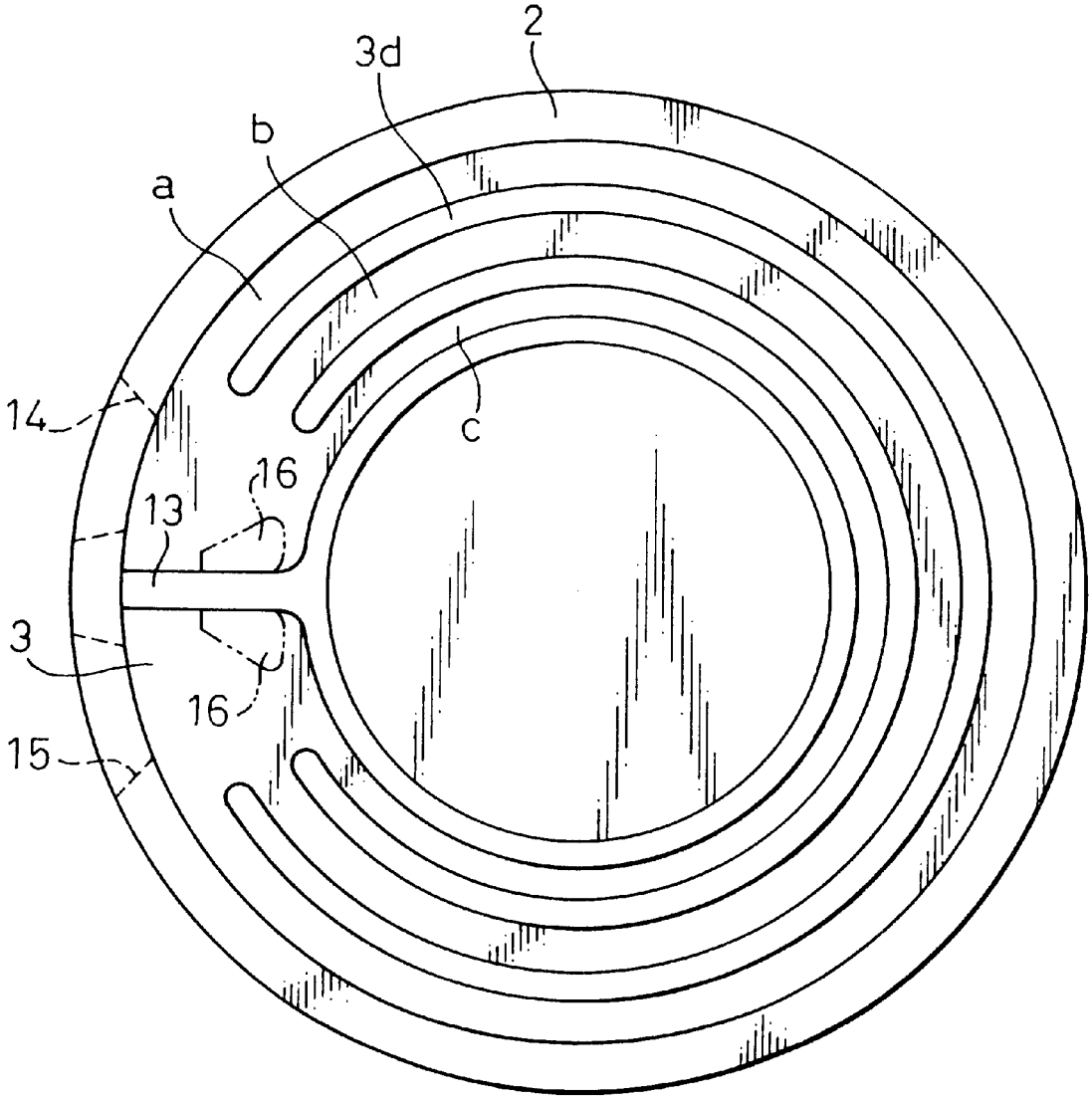
FIG. 2 is a side view of a side view of a plate member assembly, illustrating especially a movable plate member of the plate member assembly.

Referring to FIGS. 1 and 2, a variable heat generating viscous fluid type heat generator is provided with a housing assembly forming an outer framework of the heat generator to contain therein a heat generating unit and a heat exchanging unit. The housing assembly has a front housing 1 in the form of a bell defining therein a cylindrical chamber to receive therein the heat generating unit and the heat exchanging unit. The front housing 1 has a central axis thereof extending longitudinally, and is provided with a hollow boss portion 1*a* extending frontward from a circular base portion 1*b* extending radially from the central axis of the front housing 1 The front housing is also provided with a hollow cylindrical portion 1*c* extending rearward from the base portion 1*b* and having an outer diameter larger than that of the hollow boss portion 1*a*. The cylindrical portion 1*c* has one axial end formed as a large open mouth through which a front plate member 2 and a movable plate member 3 are assembled into the cylindrical chamber of the housing of the front housing 1 The open mouth of the cylindrical portion 1*c* of the front housing 1 is closed by a rear housing 4 connected to a rear end of the cylindrical portion 1*c* by means of a plurality of screw bolts shown in FIG. 1.

The front plate member 2 is fixedly arranged in the cylindrical chamber of the front housing 1, and has a disc-like base wall portion 2*a* and a cylindrical rim portion 2*b* arranged integrally with an outer circumference of the base wall portion 2*a*. The cylindrical rim portion 2*b* of the front plate 2 is fitted in an entire portion of a cylindrical inner wall surface of the cylindrical portion 1, and is in contact with both of a circularly extending inner wall surface of the front housing 1 and a circularly extending inner wall surface of the rear housing 4. The front plate member 2 is further provided with a later-described annular step 2*c* formed in an inner wall portion of the cylindrical rim portion 2*b* and a plurality of cylindrical fins 2*d* formed in a front face of the base wall portion 2*a* of the front plate member 2.

The movable plate member 3 has a disc-like base wall portion 3*a* provided with an outer circumference slidably fitted in a cylindrical bore formed by a rear portion of the cylindrical rim portion 2*b* of the front plate member 2. The outer circumference of the above-mentioned base wall portion 3*a* is in axially slidable contact with the bore wall but is sealed by a suitable seal, i.e., an O-ring $S_4$. The movable plate member 3 also has a plurality of later-described circular fins 3*d*.

The base wall portions 2*a* of the front plate member 2 and the base wall portion 3*a* of the movable plate member 3 axially confront one another, and form a predetermined cylindrical region axially bounded by a circular inner wall surface of a cylindrical recess formed in the base wall portion 2*a* and a substantially flat circular inner wall surface of the base wall portion 3*a* of the movable plate member 3. The predetermined cylindrical region is arranged as a fluid-tight heat generating chamber 5 which has a width specifically defined as a distance between the circular inner wall surface of the base wall portion 2*a* and the flat circular inner wall surface of the base wall portion 3*a*.

In the described embodiment, the front housing 1, the front plate member 2, and the rear housing 4 form a stationary portion of the housing assembly and the movable plate member 3 forms a movable portion of the housing assembly.

Within the cylindrical chamber of the front housing 19 a central portion of the front plate member 2 is axially fitted in a central bore portion formed inside the circular base wall portion 1*b* of the front housing 1 to form an axially extending front engaging portion 6 sealed by a suitable seal such as an O-ring $S_2$. Similarly, a central portion of the movable plate member 3 and a central portion of the rear housing 4 form an axially extending rear engaging portion 7 sealed by a suitable seal such as an O-ring $S_3$. The front engaging portion 6 and a front portion of the cylindrical rim portion 2*b* of the front plate member 2 define an annularly extending region formed as a front heat-receiving chamber FW arranged adjacent to a front portion of the heat generating chamber 5. The rear engaging portion 7 and a rear portion of the cylindrical rim portion 2*b* of the front plate member 2 define an annularly extending region formed as a rear heat receiving chamber RW arranged adjacent to a rear portion of the heat generating chamber 5. The front and rear heat receiving chambers FW and RW are sealed by the seal (the O-ring $S_1$) against the atmosphere. Also, the front and rear heat receiving chambers FW and RW are fluid-tightly sealed by the afore-mentioned O-rings $S_2$ and $S_3$ against radially regions of the housing assembly. The O-ring $S_4$ seals the contacting portion of the cylindrical rim portion 2*b* of the front plate member 2 and the outer circumference of the base wall portion 3*a* of the movable plate member 3 while permitting a small amount of axial movement of the movable plate member 3 against the cylindrical rim portion 2 of the front plate member 2. The annular step 2*c* formed in the base wall portion 2*a* of the front plate member 2 is provided for determining an axial limit of the movable plate member 3 with respect to the front plate member 2. Therefore, the annular step 2*c* of the front plate member 2 determines the smallest axial width of the heat generating chamber 5.

A drive shaft 8 is inserted in the boss portion 1*a* of the front housing 1, and is rotatably supported by axially spaced anti-friction bearings 9 and 10 seated in the boss portion la and the base portion 1*b* of the front housing 1. An innermost end (a rear end) of the drive shaft 8 extends in the heat generating chamber 5 and rotatably supports thereon a rotor element 11 positioned within the heat generating chamber 5. The rotor element 5 is fitted on the rear end of the drive shaft 8 via a splined engagements and therefore, the rotor element 11 can be rotated together with the drive shaft 8, and is axially shiftable on the drive shaft 8.

An oil seal 12 is mounted around a portion of the drive shaft 8 and arranged adjacent to the front portion of the heat generating chamber 5. The oil seal 12 is also housed in the central portion of the front plate member 2 and positioned inside the afore-mentioned engaging portion 6. Thus, the oil seal 12 is provided for preventing a later-described viscous fluid, i.e., silicone oil from leaking from the heat generating chamber 5.

The plurality of circular fins 2*d* and 3*d* are formed in the faces of the base wall portions 2*a* and 3*a* of the front and movable plate members 2 and 3, so that the fins 2*d* and 3*d* project into the front and rear heat receiving chambers FW and RW, respectively The fins 2*d* of the front heat receiving chamber FW are arranged to be coaxial with one another, and similarly, the fins 3*d* in the rear heat receiving chamber RW are arranged to be coaxial with one another as best shown in FIG. 2. Further, as will be understood from FIG. 2, the rear heat receiving chambers RW is provided with a partition wall 13 formed as a radially extending wall provided in the movable plate member 3. Thus, the rear heat receiving chamber RW is separated by the partition wall 13, and further divided by the circular fins 3*d* into a plurality of flow passages "a" through "c". A similar construction and arrangement is also provided in the front heat receiving chamber FW by the provision of a partition wall (not shown in FIG. 2) and the circular fins 2*d* (see FIG. 1). The front and rear heat receiving chambers FW and RW are provided with inlet ports 14, respectively, and outlet ports 15, respectively, which are formed in the cylindrical rim portion 2*b* of the front plate member 2. The inlet and outlet ports 14 and 15 are fluidly connected to conduits (not shown in FIGS. 1 and 2) through which a heat exchanging liquid constantly circulates via the front and rear heat receiving chambers RW and FW. It should be noted that the flow passages "a" through "c" are formed so that the respective widths of the plurality of passages "a" through "c" gradually increase from radially inside toward radially outside of the heat receiving chambers FW and RW. Namely, the difference in the radial widths of the flow passages "a" through "c" contributes to forming an equal flow velocity of the heat exchanging liquid within the respective flow passages "a" through "c" of the front and rear heat receiving chambers FW and RW.

It should be understood that the above-mentioned radial partition walls 13 formed in the respective base wall portions 2*a* and 3*a* of the front and movable plate members 2 and 3 are arranged to be engaged with suitable shoulder portions 16 formed in the front and rear housings 1 and 4 for preventing the two plate members 2 and 4 from being rotated during the operation of the viscous fluid type heat generator.

It should further be understood that the inner wall surfaces of the front and rear heat receiving chambers FW and RW formed by the front and movable plate members 2 and 3 are formed as rough surfaces. Namely, since the front and movable plate members 2 and 3 are usually made of a metallic material by using a casting method, portions of the plate members 2 and 3 forming the inner wall surfaces of the front and rear heat receiving chambers FW and RW are not machined and left as cast for the purpose of enhancing a heat exchanging efficiency through the wall surface of the front and rear heat receiving chambers FW and RW.

A viscous fluid such as a silicone oil is filled in a fluid filled gap provided between the entire inner wall surface of the heat generating chamber 5 sealed by the O-ring $S_4$ and the entire outer face of the rotor element 11. Thus, the viscous fluid in the fluid filled gap in the heat generating chamber 5 is subjected to a shearing action due to the rotation of the rotor element 11 within the heat generating chamber 5 The viscous fluid type heat generator is provided with an air-tight cavity region 17 defined between the central portion of the movable plate member 3 and the central portion of the rear housing 4 and located radially inside the rear engaging portion 7. The air-tight cavity region 17 is used as a heat generation control chamber in which a moving unit for causing an adjusted axial displacement of the movable plate member 3 with respect to the fixedly arranged front plate member 2 is arranged.

In the first embodiment of the present invention, the moving unit includes an elastic element, e.g., a compression coil spring 18, which urges the movable plate member 3 in an axial direction toward the front plate member 2 so as to reduce the width of the heat generating chamber 5 The moving unit also includes a vacuum introducing means for introducing a vacuum pressure from an external vacuum source into the heat generation control chamber 17. The vacuum introducing means includes a gas conduit 19 which has one end sealingly attached to the rear housing 4 and fluidly connected to the heat generation control chamber 17, and the other end (not shown) which can be connected to the vacuum source, e.g., an engine intake manifold of a vehicle incorporating therein a vehicle heating system, via a solenoid valve (not shown). The solenoid valve is provided so as to operate in response to a control signal such as a temperature detecting signal indicating either the temperature of the heat exchanging liquid circulating through the heat receiving chambers FE and RW of the heat generator or the atmospheric temperature in an objective heated area heated by the heating system. When the solenoid valve is operated and provides a communication between the engine intake manifold and the heat generation control chamber 17 via the gas conduit 19, a vacuum pressure is introduced into the heat generation control chamber 17 so as to reduce a pressure level in the heat generation control chamber 17 from the atmospheric pressure previously prevailing in the chamber 17. Therefore, the movable plate member 3 is allowed to move away from the front plate member 2 against the elastic force of the compression spring 18. Therefore, by controlling the introduction of the vacuum pressure into the heat generation control chamber 17, it is possible to adjust the axial movement of the movable plate member 3 with respect to the fixed front plate member 2, and accordingly, the axial width of the heat generating chamber 5 can be adjustably changed. The axial movement of the movable plate member 3 in a direction away from the fixed front plate member 2 is restricted by an inner end 4*a* of a cylindrical boss which forms the engaging portion 7 of the movable plate member 2 in the central portion of the rear housing 4. Namely, when the base wall portion 3*a* of the movable plate member 3 abuts against the inner end 4*a* of the cylindrical boss of the rear housing 4 during its movement away from the front plate member 2, the movable plate member 3 is stopped to establish a maximum width of the heat generating chamber 5.

When the viscous fluid type heat generator of the first embodiment is incorporated in the vehicle heating system, and when the drive shaft 8 is driven by the vehicle engine via a belt pulley mechanism and/or a solenoid clutch, the rotor element 11 mounted on the drive shaft 8 is rotated within the heat generating chamber 5. Therefore, the viscous fluid (the silicone oil) in the fluid filled gap between the outer face of the rotor element 11 and the inner wall surface of the heat generating chamber 5 is subjected to a shearing action due to the rotation of the rotor element 11, and accordingly, heat is generated in the viscous fluid. The heat is transmitted to the heat exchanging liquid flowing through the front and rear heat receiving chambers FW and RW, and is carried to the heating system by which the heat is transmitted to the objective heated area such as the vehicle's passenger compartment.

In the construction of the viscous fluid type heat generator of the first embodiment, the front and movable plate members 2 and 3 defining the heat generating chamber 5 and the front and rear heat receiving chambers FW and RW by the cooperation with the front and rear housings 1 and 4 are enclosed by the cylindrical portion 1*c* of the front housing 1 except for only the open end of the cylindrical portion 1*c* of the front housing 1, and the open end of the cylindrical portion 1*c* is fluid-tightly closed by the rear housing 4 via the O-ring $S_1$. Therefore, the interior of the viscous fluid type heat generator is completely sealed against the atmosphere. Thus, leakage of the heat exchanging liquid from the front and rear heat receiving chambers FW and RW can be prevented. Further, the viscous fluid type heat generator of the first embodiment can be very simply and efficiently manufactured and assembled due to the employment of the cylindrical front housing 1 and the disc-like rear housing 4, and the simple seal elements consisting of O-rings S through $S_4$.

In the described first embodiment of the present invention, the front and movable plate members 2 and 3 defining the front and rear heat receiving chambers FW and RW are provided with fins 2*d* and 3*d*, and these plate members 2 and 3 produced by casting have a rough cast surface Therefore, the surface area of the front and rear heat receiving chambers FW and RW can be large enough to enhance the heat exchanging efficiency between the viscous fluid and the heat exchanging liquid through the wall surface of the front and rear heat receiving chambers FW and RW.

The front and movable plate members 2 and 3 are provided, at the radially central portions thereof, with the axially extending engaging portions 6 and 7 which form the radially inner regions of the front and rear heat receiving chambers FW and RW. Further, the engaging portion 7 is sealed by the O-rings $S_3$ so that a relative movement between the movable plate member 3 and the rear housing 4 is allowed. The O-ring $S_2$ is arranged to seal the cylindrical contacting surfaces of the engaging portions 6 of the front plate member 2 and the front housing 1. Thus, even if a relative axial movement occurs between the plate members 2 and 3 and the front and rear housings 1 and 4 due to thermal deformation of these four members and during a later-described changing of the heat generating performance, the sealing of the interior of the heat generator can be surely maintained Therefore, the leaking of the heat exchanging liquid from the front and rear heat receiving chambers FW and RW can be surely prevented even if any movement of the plate members 2 and 3 against the front and rear housings 1 and 4 occurs.

When the heat exchanging liquid is introduced into the heat generator via a conduit (not shown in FIGS. 1 and 2) connected to the front housing 1, the liquid is introduced into the front and rear heat receiving chambers FW and RW via the inlet ports 14 (see FIG. 2), and the liquid is then circulated through the divided flow passages "a" through "c" within the front and rear heat receiving chambers FW and RW. Then, the heat exchanging liquid comes out of both heat receiving chambers FW and RW through the outlet ports 15 which are arranged symmetrically with the inlet ports 14 with respect to the radial partition walls 13, so that the heat exchanging liquid receiving the heat from the heat generating chamber 5 is delivered toward the circulating conduit of the heating system.

It should be noted that as described before, the divided flow passages "a" and "c" of the front and rear heat receiving chambers FW and RN are formed so as to have radial widths which are gradually increased from the radially inside toward the radially outside of the heat receiving chambers FW and RW as shown in FIG. 2. Therefore, the flow speeds of the heat exchanging liquid flowing in the respective circular flow passages "a" and "c" within the front and rear heat receiving chambers FW and RW are made equal. Consequently, the heat exchanging liquid with an equal flow speed, flows through all portions of the front and rear heat receiving chambers FW and RW so as to perform an effective heat exchanging operation through the wall surface of the front and rear heat receiving chambers FW and RW defined by the front and movable plate members 2 and 3. Thus, the heat transmission from the viscous fluid within the heat generating chamber 5 to the heat exchanging liquid flowing through the front and rear heat receiving chambers FW and RW can be achieved with a high heat exchanging efficiency.

When the heat supply from the viscous fluid type heat generator to the external heating system, i.e., the vehicle heating system is reduced or stopped, a control signal indicating the reduction in or the stopping of the heat supply is applied to the solenoid valve which is arranged in the gas conduit 19 connected to the engine manifold. The control signal may be a command signal applied by an operator, i.e., a driver of the vehicle or an automatic temperature detecting signal indicating the temperature of the heat exchanging liquid or that in the passenger compartment. Thus, the gas conduit 19 is switched so as to introduce vacuum from the engine intake manifold into the heat generation control chamber 17 which has been filled with the air. Therefore, the movable plate member 3 is moved away from the front plate member 2 against the elastic force of the compression coil spring 18 until the movable plate member 3 is stopped by the inner end 4*a* of the boss of the rear housing 4. Consequently, the axial width of the heat generating chamber 5, and thus, the axial gap size of the fluid filled gap between the inner wall surface of the heat generating chamber 5 and the outer face of the rotor element 11 are increased so as to reduce heat generation in the viscous fluid held in the fluid filled gap. During the increasing of the axial width of the heat generating chamber 5, the air which has been unavoidably contained within the heat generating chamber 5 is thermally expanded so as to compensate for a vacuum produced in the heat generating chamber 5 during the increasing of the axial width of the heat generating chamber 5. Therefore, the viscous fluid, i.e., the silicone oil, does not come into contact with any fresh air, and accordingly, the viscous fluid is not degraded.

When the heat supply from the viscous fluid type heat generator to the vehicle heating system must be increased, the afore-mentioned control signal is applied to the solenoid valve which operates so as to connect the gas conduit 19 to the atmosphere. Therefore, the atmospheric pressure is introduced into the heat generation control chamber 17 through the gas conduit 19, and accordingly, the movable plate member 3 is moved by the elastic force of the compression coil spring 18 toward the front plate member 2 until the base wall portion 3*a* of the movable plate member 3 is stopped by the annular step 2*c* of the front plate member 2 functioning as a limiting means of the axial movement of the movable plate member 3. Thus, the axial width of the heat generating chamber 5 is reduced so as to reduce the gap size of the fluid filled gap in the heat generating chamber 5, and accordingly, heat generation in the viscous fluid is increased to increase the supply of heat from the heat generator to the vehicle heating system. It should be understood that in the viscous fluid type heat generator of the first embodiment, the heat generating performance thereof can be adjustably changed without controlling the starting and stopping of the operation of the heat generator per se via the solenoid clutch.

In the described heat generator of the first embodiment, the rotor element 11 is splined with the end portion of the drive shaft 8. Therefore, the rotor element 11 can be axially shifted within the heat generating chamber 5. Therefore, during the above-described increasing and reducing of the axial width of the heat generating chamber 5, the rotor element 11 is shifted to a substantially middle position in the heat generating chamber 5 so as to receive balanced fluid pressures across the rotor element 11 Thus, the fluid filled gap on both sides of the rotor element 11 can constantly produce substantially equal amount of frictional heat in the viscous fluid.

In the modified form of the first embodiment, the rotor element 11 may be axially fixedly attached to the drive shaft 8. In such modified form, the gap size of the fluid filled gaps on both sides of the rotor element 11 will be different from one another depending on the axial movement of the movable plate member 3. For example, when the movable plate member 3 is moved away from the front plate member 2 to increase the axial width of the heat generating chamber 5, the fluid filled gap formed between the face of the movable plate member 3 and the outer face of the rotor element 11 is increased so that the gap size of this fluid filled gap is made larger than that of the fluid filled gap between the face of the front plate member 2 and the outer face of the rotor element 11. Thus, heat generation in the formed fluid filled gap becomes smaller than that in the latter fluid filled gap, and accordingly, there occurs a difference in the amount of heat generation between the opposite fluid filled gaps. Nevertheless, when the movable plate member 3 is moved away from the front plate member 3, the internal volume of the rear heat receiving chamber RW is also reduced to reduce the heat exchanging surface area of the rear heat receiving chamber RW. Thus, the reduction in the heat generation can be well balanced by the corresponding reduction in the heat exchanging surface area of the rear heat receiving chamber RW.

It should be understood that, in the heat generator of the first embodiment, a large gap produced between the oil seal device 12 and the front outer face of the rotor element 11 does not contribute to heat generation by the viscous fluid.

Figure 3:
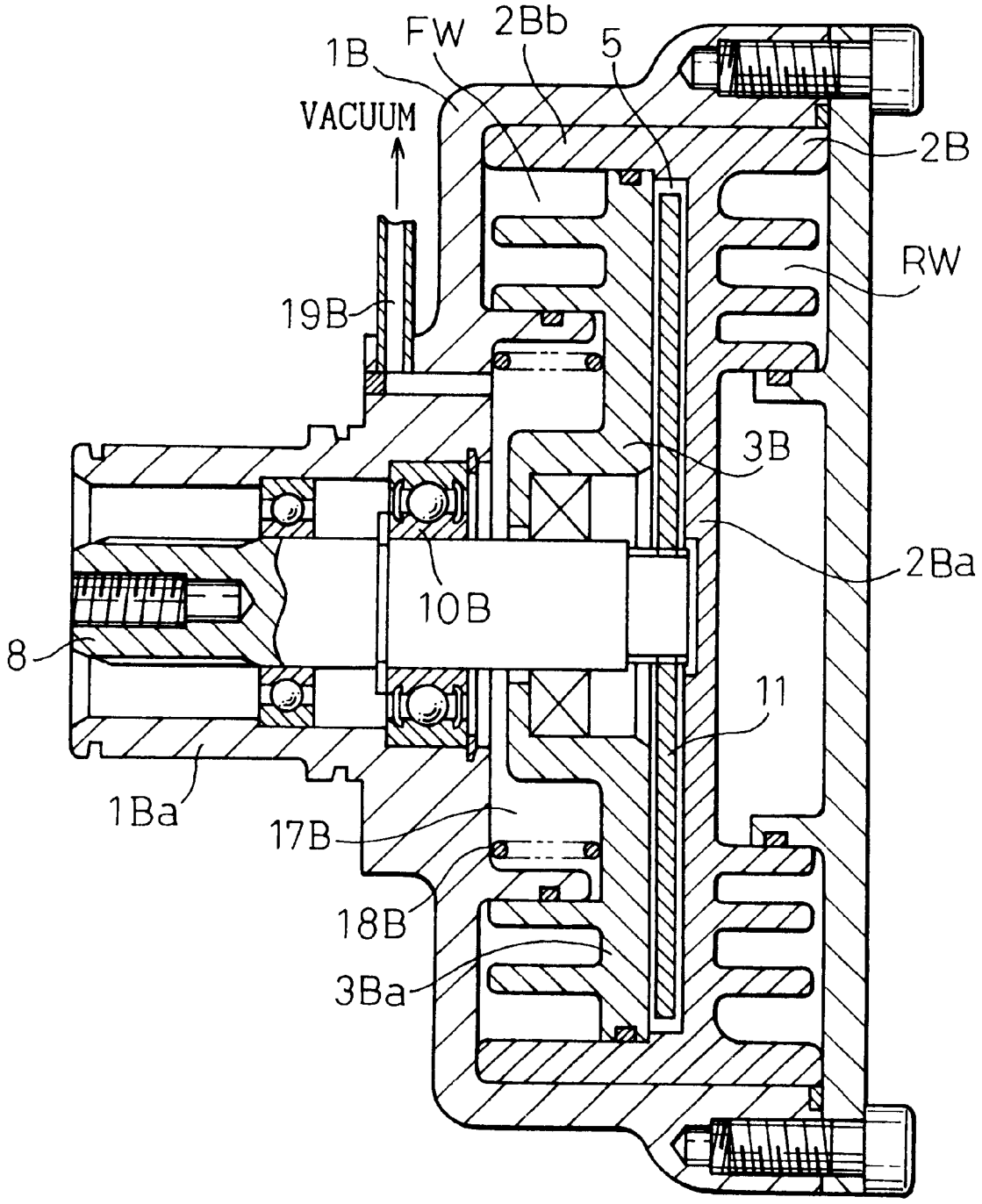
FIG. 3 is a longitudinal cross-sectional view of a variable heat generating viscous fluid type heat generator according to a second embodiment of the present invention.

FIG. 3 illustrates a variable heat generating viscous fluid type heat generator according to the second embodiment of the present invention.

The viscous fluid type heat generator of the second embodiment is different from that of the first embodiment in an arrangement of the front and movable plate members. Namely, in the second embodiment, the movable plate member 3B is arranged on the front side of the fixed plate member 2B within the interior of the housing assembly of the heat generator. The movable plate member 3B is provided with a base wall portion 3B*a*, a central boss formed integrally with the base wall portion 3B*a* and extending frontward from a central portion of the base wall portion 3B*a*, and a plurality of fins similar to fins 3*d* of the movable plate member 3 of the first embodiment. An outer circumference of the base wall portion 3B*a* is slidably fitted in a cylindrical bore defined by an inner cylindrical wall of an annular rim portion 2B*b* of the fixed plate member 2B. Thus, the movable plate member 3B can be axially moved frontward and rearward with respect to the annular rim portion 2B*b* of the fixed plate member 2B. A contacting portion of the outer circumference of the movable plate member 3B and the inner cylindrical wall of the rim portion 2B*b* of the fixed plate member 2B is sealed by a suitable seal such as an O-ring similar to the O-ring $S_4$ of the first embodiment.

A heat generation control chamber 17B is provided in a predetermined region bounded by the above-mentioned central boss of the movable plate member 3B and the inner boss portion formed in a central portion of a front housing 1B similar to the housing 1 of the first embodiment, and the heat generation control chamber 17B is formed as an air-tight chamber sealed by the sealed type anti-friction bearing 10B seated in a base portion of a central boss 1B*a* of the front housing 1B.

The viscous fluid type heat generator of the second embodiment is provided with a moving unit in the above-mentioned heat generation control chamber 17B for moving the movable plate member 3B in an axial direction with respect to the fixed plate member 2B. The moving unit includes a compression coil spring 18B similar to the compression coil spring 18 of the first embodiment. The coil spring 18B is arranged between the inner surface of the front housing 1B and a face of the base wall portion 3B*a* of the movable plate member 3B, and constantly urges the movable plate member 3B toward a base wall portion 2B*a* of the fixed plate member 2B. The moving unit further includes a vacuum introducing means having a gas conduit 19B, which introduces a vacuum pressure into the heat generation control chamber 17B. The vacuum introducing means is the same as that of the first embodiment, and when a vacuum pressure is introduced into the heat generation control chamber 17B, the movable plate member 3B is allowed to move away from the base wall portion 2B*a* of the fixed plate member 2B against the spring force of the compression coil spring 18B. The gas conduit 19B of the vacuum introducing means is connected to an external vacuum source, i.e., an engine intake manifold of a vehicle engine via a suitable solenoid valve similar to the solenoid valve described with reference to the first embodiment.

It should be understood that since the other internal construction and operation of the viscous fluid type heat generator of the second embodiment are substantially the same as those of the first embodiment, a detailed description thereof is omitted here for the sake of simplicity.

It should further be understood that the fixed front plate member 2 of the first embodiment and the fixed plate member 2B of the second embodiment may be formed to be integral with the front housings 1 and 1B or the rear housing 4 of both embodiments from the view point of manufacturing and assembling the housing assembly. Then, a single heat receiving chamber may be arranged between the movable plate member 3 or 3B and the fixed housing assembly. In such a modified case, the movable plate member 3 or 3B can be used for adjustably changing the axial width of the heat generating chamber 5 of the heat generator in the same manner as the first and second embodiments.

Further, in another modified embodiment of the first and second embodiments, the moving unit for axially moving the movable plate member 3 or 3B may be comprised of only an urging means which may be constituted by a compression spring. The urging means will be used to urge the movable plate member 3 or 3B in a single direction reducing the axial width of the heat generating chamber 5. Namely, a vacuum introducing means including the gas conduit 19 or 19B may be deleted. Then, the return of the movable plate member 3 or 3B from the urged position thereof toward a position increasing the axial width of the heat generating chamber 5 will be achieved by an increase in a pressure of the viscous fluid within the heat generating chamber, which is caused by an increase in the temperature of the viscous fluid during the heat generating operation of the heat generator. The increase in the fluid pressure within the heat generating chamber 5 will move the movable plate member 3 or 3*b* in a direction increasing the axial width of the heat generating chamber 5 against the urging force exerted by the urging means. Thus, the heat generation will be reduced. Accordingly, thermal degradation of the viscous fluid can be prevented.

Figure 4:
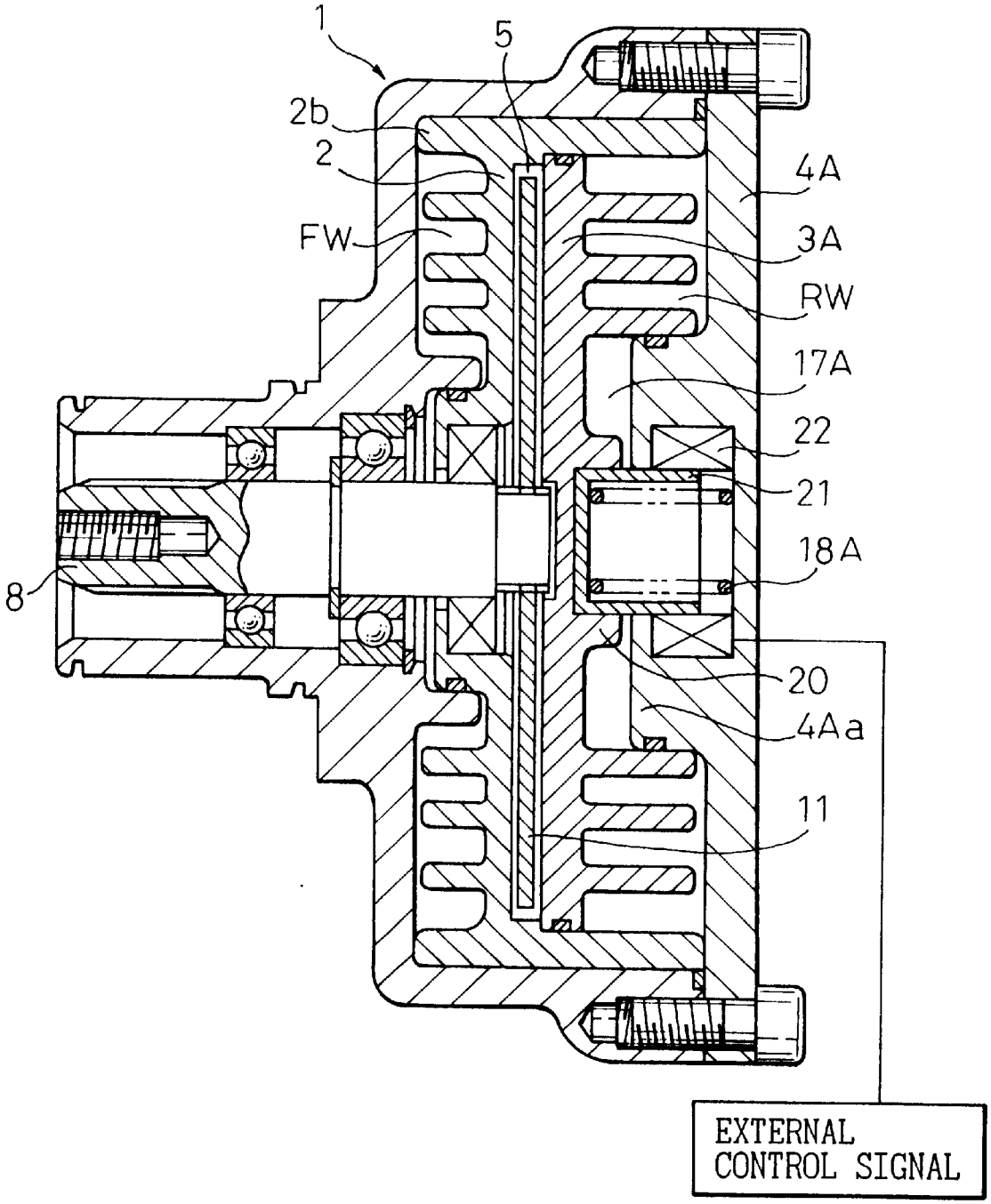
FIG. 4 is a longitudinal cross-sectional view of a variable heat generating viscous fluid type heat generator according to a third embodiment of the present invention.

FIG. 4 illustrates the third embodiment of the present invention.

From comparing FIG. 4 with FIG. 1, it will be understood that a variable heat generating viscous fluid type heat generator of the third embodiment is provided with a heat generating chamber 5 and a pair of front and rear heat receiving chambers FW and RW, constructed in the same manner as those of the viscous fluid type heat generator of the first embodiment. Namely, the viscous fluid type heat generator of the third embodiment includes a housing assembly provided with a front housing 1, a rear housing 4A, a fixed plate member 2, a movable plate member 3A. Thus, a heat generating chamber 5 is arranged in a region axially bounded by the fixed plate member 2 and the movable plate member 3A, and a pair of front and rear heat receiving chambers FW and RW are arranged adjacent to front and rear portions of the heat generating chamber 5 in which a rotor element 11 is rotatably supported by a drive shaft 8. However, a moving unit for axially moving the movable plate member 3A with respect to the fixed plate member 2 is different from the moving unit for moving the movable plate member 2 of the viscous fluid type heat generator of the first embodiment The description of the moving unit of the heat generator of the third embodiment will be provided herein below.

In the viscous fluid type heat generator of FIG. 4, a heat generation control chamber 17A is formed as an annular chamber defined between a central portion of a rear face of the movable plate member 3A and a central portion of the rear housing 4A. The central portion of the rear face of the movable plate member 3A has a cylindrical boss portion 20 projecting rearwardly into the heat generation control chamber 17A in order to receive therein a cap-shape iron core 21 which is press-fitted in the bore of the cylindrical boss 20. The central portion of the rear housing 4A has a cylindrical projection 4Aa provided with an axial bore formed therein. A compression coil spring 18A is arranged between a bottom face of the axial bore of the cylindrical projection 4Aa of the rear housing 4 and a bottom face of the cap-shape iron core 21, so that the compression coil spring 18A constantly urges the movable plate member 3A in an axial direction to reduce an axial width of the heat generating chamber 5. A solenoid 22 is housed in the axial bore of the cylindrical projection 4Aa of the rear housing 4A so as to electro-magnetically cooperate with the iron core 21 attached to the movable plate member 3A. When electrically energized, the solenoid 22 applies a magnetic attractive force to the movable plate member 3A via the iron core 21 in an axial direction to move the movable plate member 3A against the elastic force of the compression coil spring 18A, i.e., in an axial direction to increase an axial width of the heat generating chamber 5. The solenoid 22 is electrically connected to an external electric circuit in order to receive an external control signal by which energizing and de-energizing of the solenoid 22 are controlled. The external control signal may be either a signal provided by an operator (e.g., a vehicle driver) via a suitable control switch in the vehicle control panel or an automatic signal produced in response to a temperature detecting signal indicating a temperature of the heat exchanging liquid in the front and rear heat receiving chambers FW and RW or a temperature in the objective heated area such as a passenger compartment of the vehicle. The external control signal may further be either a temperature detecting signal indicating a temperature of the viscous fluid within the heat generating chamber 5 or a rotation detecting signal indicating a specified rotating speed of the rotor element 11. The specified rotating speed of the rotor element 11 is determined e.g., by taking into account prevention of thermal degradation of the physical property of the viscous fluid.

In the heat generator of the third embodiment, when the solenoid 22 of the moving unit is de-energized, the movable plate member 3A is urged by the compression coil spring 18A toward a position where the axial width of the heat generating chamber 5 is reduced to its minimum state, and accordingly, the fluid filled gap between the inner wall surface of the heat generating chamber 5 and the outer face of the rotor element 11 is maintained at the smallest gap size exhibiting a maximum heat generating performance. When heat supply from the heat generator to the associated heating system should be reduced, the solenoid 22 is energized in response to application of the external control signal to magnetically attract the movable plate member 3A via the iron core 21 in a direction to increase the gap size of the fluid filled gap in the heat generating chamber 5 against the elastic force of the compression coil spring 18A. Therefore, the heat generation in the viscous fluid held in the fluid filled gap is reduced to a desired level. The axial movement of the movable plate member 3A provided by the solenoid 22 is restricted when the cylindrical boss portion 20 of the movable plate member 3A abuts against the cylindrical projection 4Aa of the rear housing 4A.

Figure 5:
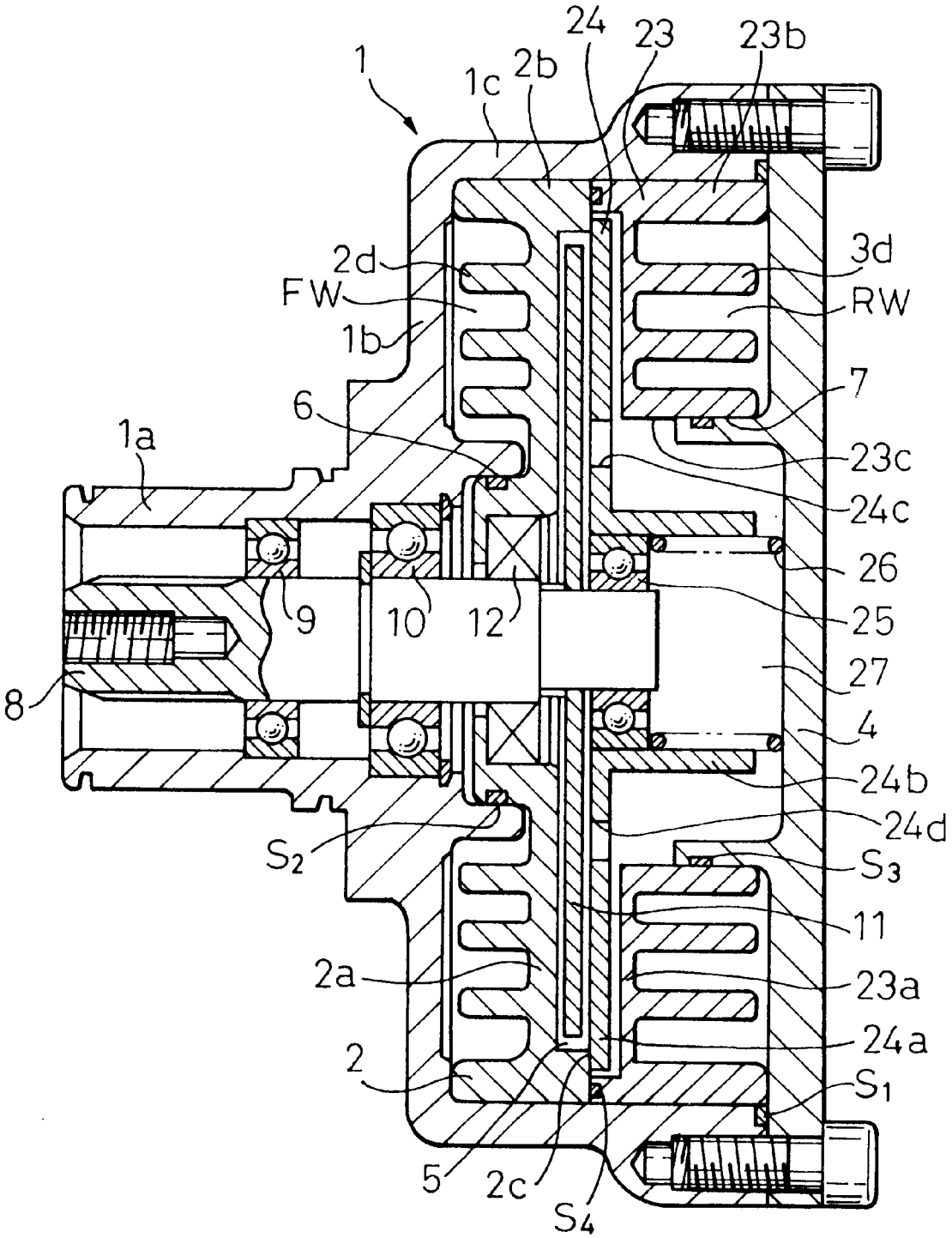
FIG. 5 is a longitudinal cross-sectional view of a variable heat generating viscous fluid type heat generator according to a fourth embodiment of the present invention.
Figure 6:
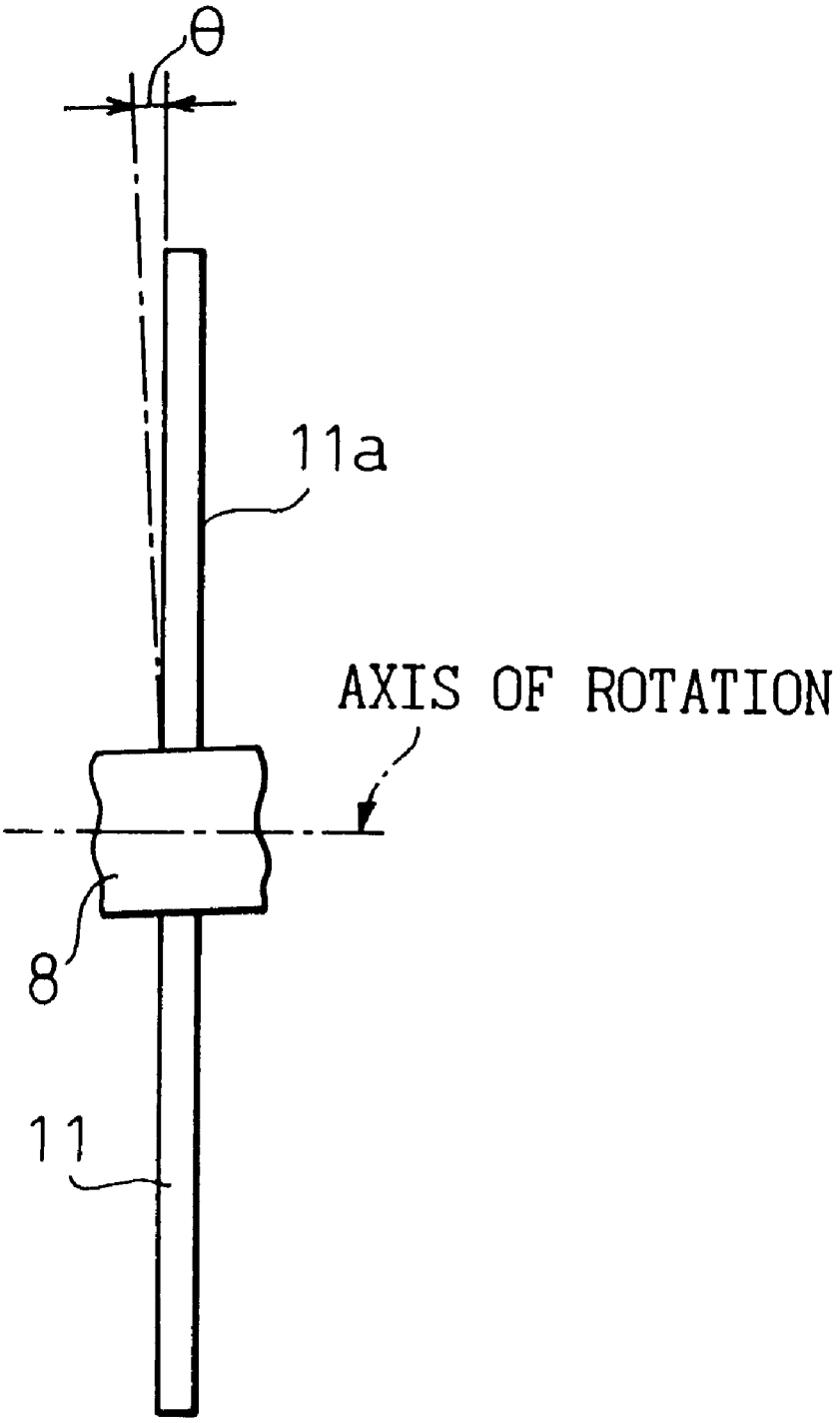
FIG. 6 is a front view of rotor element incorporated in the heat generator of the fourth embodiment of the present invention.

FIGS. 5 and 6 illustrate a variable heat generating viscous fluid type heat generator according to a fourth embodiment of the present invention.

In the viscous fluid type heat generator of the fourth embodiment, the housing assembly includes a front housing 1 and a rear housing 4 which are similar to the front housing 1 and the rear housing 4 of the first embodiment. Thus, the front housing 1 has a cylindrical portion 1*c* defining therein a cylindrical cavity tightly closed by the rear housing 4. In the cavity of the cylindrical portion 1*c* of the front housing 1, a front fixed plate member 2 and a rear fixed plate member 23 are fixedly received so that outer cylindrical rim portions 2*b* and 23*b* of the plate members 2 and 23 are snugly fitted in the cavity wall of the cylindrical portion 1*c*. The front and rear fixed plate members 2 and 23 are provided with circular fins 2*d* and 3*d*, respectively, which project into front and rear heat receiving chambers FW and RW.

The rear fixed plate member 23 is provided, at its central portion, with an axially bored central bore 23*c* in which an axial projection of the rear housing 4 is tightly fitted to form an engaging portion 7 sealed by an O-ring $S_3$.

The rear fixed plate member 23 includes a circular base wall portion 23*a* having a large circular recess formed in a face opposite to the face from which the fins 3*d* project. In the large circular recess, a movable plate member 24 is arranged to be movable coaxially with the axis of rotation of a rotor element 11 rotatably supported by a drive shaft 8. The movable plate member 24 has a base wall portion 24*a* which is arranged to confront a base wall portion 2*a* of the front fixed plate member 2 via an axially bounded cylindrical region which forms a heat generating chamber 5.

The movable plate member 24 also has, at its central portion, a hollow cylindrical portion 24*b* extending toward the rear housing 4. The hollow cylindrical portion 24*b* receives an anti-friction bearing 25 at an innermost position of the cylindrical portion 24*b*. The bearing 25 is fixedly fitted in the bore of the cylindrical portion 24*b* but is mounted and loose-fitted on an innermost end of the drive shaft 8, so that the bearing 25 is axially movable together with the movable plate member 24 with respect to the drive shaft 8. A compression coil spring 26 is arranged between the end of the bearing 25 and the central portion of the rear housing 4 so as to urge the movable plate member 24 in a direction to reduce an axial width of the heat generating chamber 5.

The viscous fluid type heat generator is provided with a fluid storing chamber 27 formed inside the engaging portion 7 of the rear fixed plate member 23 and the rear housing 4. The fluid storing chamber 27 is fluidly communicated with the heat generating chamber 5 via a fluid withdrawing bore 24*c* and a fluid supplying bore 24*d* which are formed in the movable plate member 24.

In the described heat generator of the fourth embodiment, the rotor element 11 is fixedly mounted on the drive shaft 8 to be inclined from a plane perpendicular to the axis of rotation of the drive shaft 8 by an angle "ϕ" determined by a dimensional allowance (see FIG. 6) for allowing the rotation of the rotor element 11 within the heat generating chamber 5, as shown in FIG. 6. Thus, the opposite faces 11*a* of the rotor element 11 work as pressure increasing means when the rotor element 11 is rotated within the heat generating chamber 5 filled with the viscous fluid. The inclining angle "ϕ" of the rotor element 11 is selected as an angle between 1 through 5 degrees. The remaining internal construction of the viscous fluid type heat generator is substantially similar to that of the viscous fluid type heat generator of the first embodiment.

In the heat generator of the fourth embodiment, it should be understood that each gap extending between each inclined outer face 11*a* of the rotor element 11 and the inner wall surface of the heat generating chamber 5 is not equal, and continuously changes in the circumferential direction around the axis of rotation of the drive shaft 8. Therefore, when the rotor element 11 is rotated within the heat generating chamber 5, the pressure of the viscous fluid held in the fluid filled gap of the heat generating chamber 5 gradually changes in such a manner that a fluid pressure in a smaller gap portion is larger than that in a larger gap portion. This gradual change in the fluid pressure in the fluid filled gap of the heat generating chamber 5 works to drive a wedge between the rotor element 11 and the movable plate member 24, and the effect of the wedge is increased in response to an increase in the rotating speed of the rotor element 11. The effect of wedge due to the above-mentioned fluid pressure change produces a thrust force applied to the movable plate member 24, which urge the movable plate member 24 to be axially moved away from the rotor element 11 fixed to the drive shaft 8 in a direction which increases an axial width of the heat generating chamber 5. Since the effect of wedge provided by the fluid pressure change is increased in response to an increase in the rotating speed of the inclined rotor element 11, the axial movement of the movable plate member 24 is increased in response to the increase of the rotating speed of the rotor element 11, and accordingly, a gap size of the fluid filled gap between the rotor element 11 and the inner wall surface of the heat generating chamber 5 is increased so that heat generation is proportionally reduced. Thus, when the rotor element 11 together with the drive shaft 8 are rotated at a high speeds the heat generation can be reduced, and accordingly, thermal degradation of the viscous fluid due to excessive heating can be effectively suppressed.

When the rotor element 11 is rotated at a low speed, an increase in the fluid pressure in the fluid filled gap, due to the inclined arrangement of the rotor element 11 with respect to the axis of rotation of the drive shaft 8, is limited to result in producing a small effect of wedge. Therefore, the movable plate member 24 is moved by the elastic force of the compression coil spring 26 in a direction to reduce the axial width of the heat generating chamber 5, and in turn the gap size of the fluid filled gap between the rotor element 11 and the inner wall surface of the heat generating chamber 5. Thus, a large amount of heat is generated in the viscous fluid held in the fluid filled gap.

In the described viscous fluid type heat generator of the fourth embodiment, the rear heat receiving chamber RW is defined as a chamber having a fixed volume, enclosed by the rear fixed plate member 23 and the rear housing 4, and accordingly, an axial movement of the movable plate member 24 does not cause any change in the volume or the entire surface area of the rear heat receiving chamber RW. Thus, during the operation of the viscous fluid type heat generator, the heat exchanging liquid flowing through the rear heat receiving chamber RW can maintain a constant flow speed. Thus, noise and vibration which might be produced by a change in the flowing speed of the heat exchanging liquid are not generated.

Further, the fluid storing chamber 27 of the viscous fluid type heat generator of the fourth embodiment is arranged to store the viscous fluid of which the amount is larger than the entire volume of the fluid filled gap in the heat generating chamber 5. Further, the viscous fluid can be withdrawn from the heat generating chamber 5 into the fluid storing chamber 27 via the fluid withdrawing bore 24*c*, and can be supplied from the fluid storing chamber 27 into the heat generating chamber 5 via the fluid supplying bore 24*d*. Thus, during the operation of the viscous fluid type heat generator, replacement of the viscous fluid in the heat generating chamber 5 with that in the fluid storing chamber 27 occurs, and therefore, degradation of the viscous fluid can be avoided over the operating life of the heat generator. Further, a sufficient amount of the viscous fluid necessary for generating a sufficient amount of heat can Abe stored within the interior of the heat generator. Therefore, a reliable heat generating performance of the heat generator can be achieved by the viscous fluid type heat generator of the fourth embodiment. Furthermore, since the heat generating chamber 5 can be prevented from being exposed to an excessive fluid pressure therein, due to an arrangement of the fluid storing chamber 27, any adverse affect on a shaft seal device 12 from the fluid pressure in the heat generating chamber 5 can be prevented, and accordingly, a reliable sealing effect of the shaft seal device 12 can be guaranteed.

Figure 7:
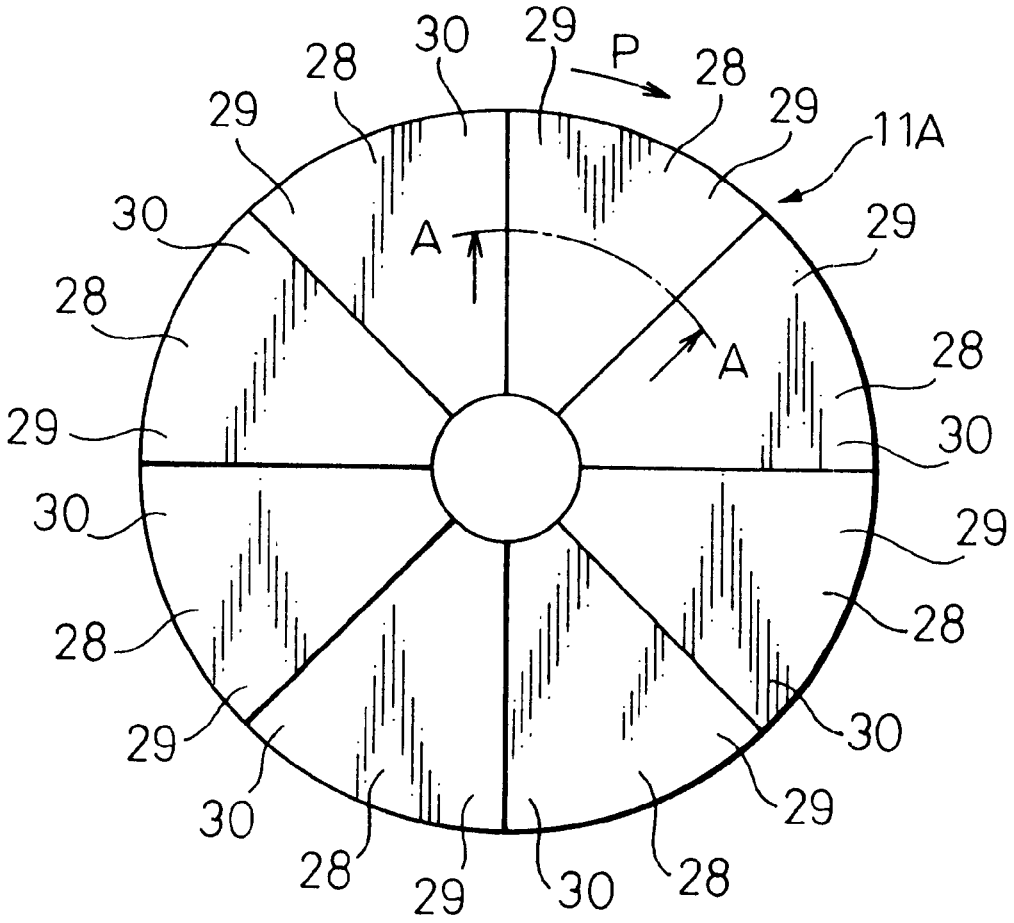
FIG. 7 is a side view of a rotor element incorporated in a variable heat generating viscous fluid type heat generator according to a fifth embodiment of the present invention.
Figure 8:
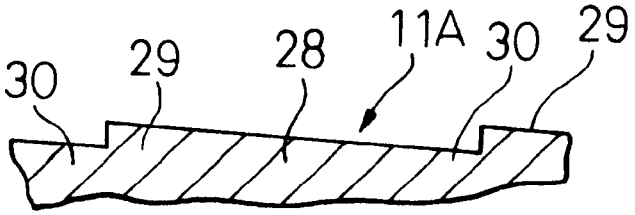
FIG. 8 is a cross-sectional view taken along the line A—A of FIG. 7.

FIGS. 7 and 8 illustrate a variable heat generating viscous fluid type heat generator according to a fifth embodiment of the present invention.

In the variable heat generating viscous fluid type heat generator of the fifth embodiment, a specified rotor element 11A is incorporated to provide a fluid pressure increasing means by which an effect of a wedge similar to that described with respect to the fourth element of FIGS. 5 and 6 can be produced. It should be understood that the remaining inner construction of the heat generator is substantially similar to that of the fourth embodiment of FIG. 5. Therefore, the elements and parts except for the specified rotor element 11A will be referred to by using the same reference numerals as those used in FIG. 5.

The specified rotor element 11A of the fifth embodiment is provided with a plurality of identical circumferentially inclined faces 28 arranged in a circumferential direction around its central axis. As best shown in FIG. 8, each inclined face 28 of the rotor element 11A is arranged between a peak 29 and a base 30, and is formed so as to ascend from the base 30 to the peak 29 in a direction reverse to the rotating direction "P" (see FIG. 7) of the rotor element 11A. The respective inclined faces 28, the peaks 29, and the bases 30 extend in a radial direction with respect to the central axis of the rotor element 11A, as will be understood from the illustration of FIG. 7. Therefore, when the rotor element 11A is rotated in a heat generating chamber, the viscous fluid held in a fluid filled gap between the rotor element 11A and an inner wall surface of the heat generating chamber 5 produces a change in fluid pressure. Namely, a fluid pressure prevailing in a region between each inclined face 28 and the confronting inner wall surface of the heat generating chamber 5 is the lowest at the base 30, and the highest at the peak 29 while changing gradually from the highest to the lowest value along the inclined face 28. Thus, the change in the fluid pressure in the fluid filled gap works to drive a wedge in that fluid filled gap and, accordingly, a wedge effect similar to the wedge effect described with reference to the fourth embodiment is produced. Namely, due to the wedge effect, a thrust force is applied to a movable plate member 24 and, therefore, the movable plate member 24 is moved away from the rotor element 11A fixedly attached to a drive shaft 8 so as to increase the axial width of the heat generating chamber 5 with respect to the rotor element 11A. Accordingly, as described before, when the rotor element 11A is rotated at a high speed, the axial width of the heat generating chamber 5 is increased by the axial movement of the movable plate member 24 to effectively prevent generation of an excessive amount of heat. Accordingly, thermal degradation of the viscous fluid can be effectively suppressed during the long operating life of the viscous fluid type heat generator.

Further, in the viscous fluid type heat generator of the fifth embodiment, the specified rotor element 11A having the inclined faces 28, the peaks 29 and the bases 30 is rotated in the heat generating chamber 5 so as to apply a shearing action to the viscous fluid filled in therein. Therefore, the peaks 29 and the bases 30 of the rotor element 11A are able to function as a means for increasing the shearing action applied to the viscous fluid compared with the rotor element having a flat outer face. More specifically, the provision of the peaks 29 and the bases 30 of the rotor element 11A changes the gap size of the fluid filled gap in the circumferential direction around the axis of rotation of the rotor element 11A. Thus, due to the change in the gap size of the fluid filled gap, the viscous fluid having a chain molecular construction therein shows a large resistance in the fluid filled gap. Consequently, the viscous fluid is subjected to a large shearing action from the rotating rotor element 11A. Thus, the heat generating performance of the viscous fluid type heat generator is increased.

Figure 9:
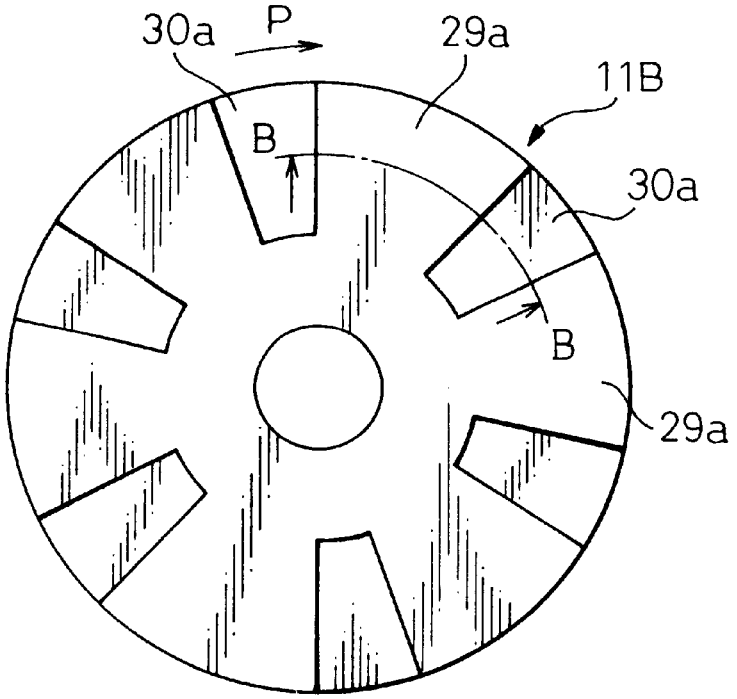
FIG. 9 is a side view of a rotor element incorporated in a variable heat generating viscous fluid type heat generator according to a sixth embodiment of the present invention.
Figure 10:
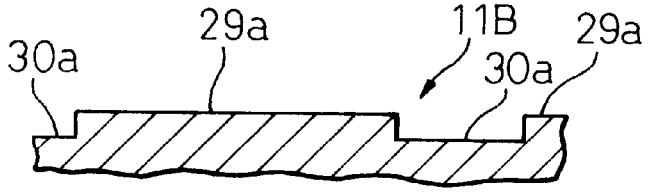
FIG. 10 is a cross-sectional view taken along the line B—B of FIG. 9.

FIGS. 9 and 10 illustrate a variable heat generating viscous fluid type heat generator according to a sixth embodiment of the present invention.

In the variable heat generating viscous fluid type heat generator of the sixth embodiment, a specified rotor element 11B is incorporated. The specified rotor element 11B is provided, at its one face, with a plurality of recesses 30*a* equiangularly arranged in a circumferential direction around the central axis of the rotor element 11B. The plurality of recesses 30*a* provide a plurality of elevated portions 29*a* so that each elevated portion 29*a* is arranged between the neighboring two recesses 30*a*. Thus, an alternate arrangement of the recesses 30*a* and the elevated portions 29*a* is provided in one of the opposite face, i.e., the rear face of the rotor element 11B. Further, the recesses 30*a* and the elevated portions 29*a* extend in a radial direction with respect to the central axis of the rotor element 11B, and function as a pressure increasing means basically similar to the pressure increasing means of the rotor element 11A of the fifth embodiment.

It should be understood that the remaining inner construction of the viscous fluid type heat generator of the sixth embodiment is substantially similar to the fourth embodiment of FIG. 5.

In the rotor element 11B of the heat generator according to the sixth embodiment, the plurality of elevated portions 29*a* and the confronting face of the movable plate member 24 form a fluid filled gap of which the gap size is smaller than that of a fluid filled gap formed by the plurality of recesses 30*a* and the confronting face of the movable plate member 24. Therefore, when the rotor element 11B is rotated in a direction "P" (see FIG. 9), the viscous fluid in the fluid filled gap is frictionally pulled in the same direction as the rotating direction of the rotor element 11B. Nevertheless, the movement of the viscous fluid is not synchronized with the rotation of the rotor element 11B, and accordingly, the viscous fluid moves so as to alternately pass the recesses 30*a* and the elevated portions 29*a* of the rotor element 11B. At this stage, when the viscous fluid moves from one recess 30*a* to the neighboring elevated portion 29*a*, a pressure of the viscous fluid is increased. Thus, the increase in the fluid pressure of the viscous fluid applies a thrust force to the movable plate member 24. Therefore, the movable plate member 24 is moved away from the rotor element 11B so as to increase an axial width of the heat generating chamber 5. The recesses 30*a* and the elevated portions 29*a* of the rotor element 11B can contribute to an increase in a shearing force applied to the viscous fluid when the rotor element 11B is rotated in the heat generating chamber 5. Thus, the heat generating performance of the viscous fluid type heat generator can be enhanced.

Figure 11:
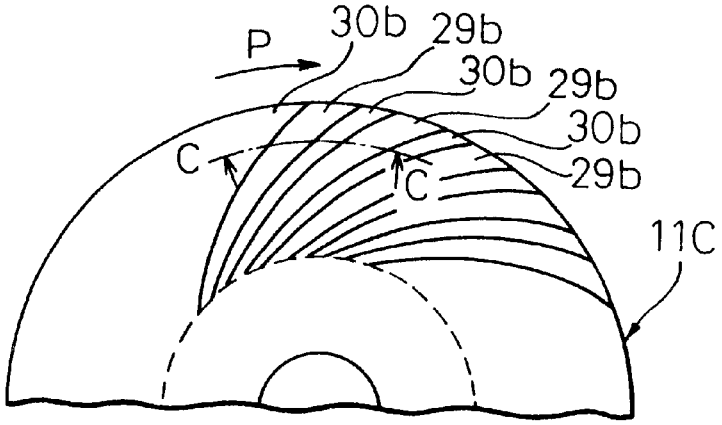
FIG. 11 is a side view of a rotor element incorporated in a variable heat generating viscous fluid type heat generator according to a seventh embodiment of the present invention.
Figure 12:
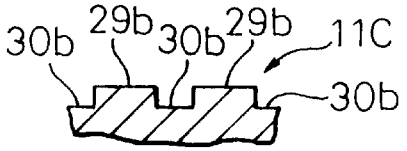
FIG. 12 is a partial cross-sectional view of the rotor elements taken along the line C—C of FIG. 11; and, FIG. 13 is a longitudinal cross-sectional view of a variable heat generating viscous fluid type heat generator according to a fourth embodiment of the present invention.

FIGS. 11 and 12 illustrate a variable heat generating viscous fluid type heat generator according to a seventh embodiment of the present invention.

In the variable heat generating viscous fluid type heat generator of the seventh embodiments a specified rotor element 11C is incorporated to provide a fluid pressure increasing means in a heat generating chamber.

It should be understood that the remaining inner construction of the viscous fluid type heat generator of the seventh embodiment is substantially similar to the fourth embodiment of FIG. 5.

The rotor element 11C of the viscous fluid type heat generator of the seventh embodiment is provided with a plurality of spirally extending recesses 30*a* formed in one of the opposite faces of the rotor element 11C, and arranged equiangularly in a circumferential direction about a central axis of the rotor element 11C. The provision of the plurality of spirally extending recesses 30*a* permits a plurality of spiral elevated portions 29*a* in the same face of the rotor element to be arranged equiangularly in the circumferential direction about the central axis of the rotor element 11C. As best shown in FIG. 12, the spiral recesses 30*a* and the spiral elevated portions 29*a* are alternately arranged. Further, the spiral recesses 30*a* and the spiral elevated portions are curved from a radial direction of the rotor element 11C in a direction corresponding to the rotating direction "P" of the rotor element 11C. It will be understood that the spiral recesses 30*a* and the spiral elevated portions 29*a* of the rotor element 11C of the seventh embodiment can provide the same fluid-pressure increasing function and shearing-action increasing function as those provided by the rotor element 11B of the sixth embodiment.

In the foregoing description of the fifth through seventh embodiments, the recesses 30, 30*a*, 30*b* and the elevated portions 29, 29*a*, and 29*b* are arranged in one of the opposite faces of the rotor elements 11A, 11B, and 11C, especially in the rear face of the respective rotor elements 11A through 11C, confronting the movable plate member 24. However, an alternative arrangement in which the recesses 30, 30*a*, 30*b* and the elevated portions 29, 29*a*, and 29*b* are arranged in the face of the movable plate member 24, facing the heat generating chamber 5, may be employed as required.

Figure 13:
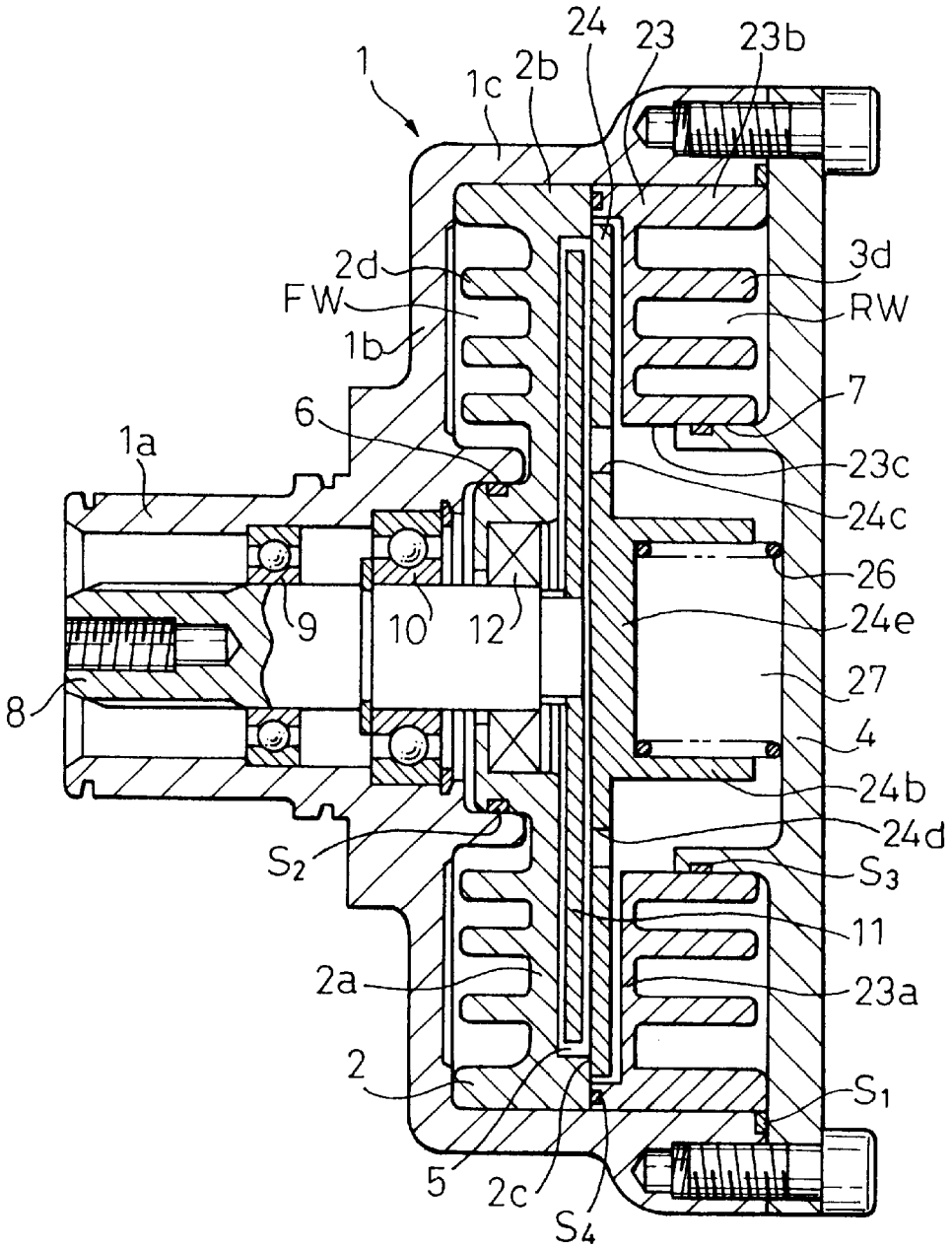

FIG. 13 illustrates a variable heat generating viscous fluid type heat generator according to an eighth embodiment of the present invention. The viscous fluid type heat generator of the eighth embodiment is different from that of the fourth embodiment shown in FIG. 5 in that the anti-friction bearing 25 fixed to the hollow cylindrical portion 24*b* of the movable plate member 24 and movably loose-fitted on the inner end of the drive shaft 8 is omitted. Further, the movable plate member 24 of the eighth embodiment is provided with a central wall portion 24*e* formed as a bottom wall of the hollow cylindrical portion 24*b*. Thus, the compression coil spring 26 functioning as an urging means for urging the movable plate member 24 toward the rotor element 11 is arranged between the central wall portion 24*e* of the movable plate member 24 and the central portion of the rear housing 4. The movable plate member 24 of the eighth embodiment is axially movably housed in the large recess formed in the front face of the rear fixed plate member 23. The remaining inner construction of the viscous fluid type heat generator of the eighth embodiment is the same as the inner construction of the viscous fluid type heat generator of fourth embodiment of FIG. 5. Therefore, the basic operation of the heat generator of the eighth embodiment is quite similar to that of the heat generator of the fourth embodiment.

From the foregoing description of the various preferred embodiments of the present inventions it will be understood that the variable heat generating viscous fluid type heat generator according to the present invention can quickly and adjustably change its heat generating performance by the employment of an arrangement in which a movable plate member defining a movable portion of the inner wall surface of the heat generating chamber, and being axially movable toward and away from a fixed portion of the inner wall surface of the heat generating chamber, to thereby adjustably change an axial width of the heat generating chamber and, in turn, a gap size of the fluid filled gap between the rotor element and the inner wall surface of the heat generating chamber. Further, in one of the preferred embodiments, since the fixed plate member arranged in the housing assembly of the heat generator defines a heat receiving chamber, in which the heat exchanging liquid flows to receive heat from the heat generating chamber, as a chamber having a constantly fixed volume therein, the movement of the movable plate member to adjustably change the fluid filled gap in the heat generating chamber does not cause any change in the volume of the heat receiving chamber. Thus, the heat exchanging liquid flowing in the heat receiving chamber can constantly maintain a stable flow without generating any vibration and noise. Therefore, the operation of the viscous fluid type heat generator can be kept quiet constantly.

Further, the variable heat generating viscous fluid type heat generator of the present invention is able to surely prevent degradation of the heat generating property of the viscous fluid over the operating life of the heat generator.

Since the variable heat generating viscous fluid type heat generator of the present invention may change its heat generating performance by the application of an external control signal, e.g., a temperature detecting signal indicating the temperature of the heat exchanging liquid or the objective heated area, to the moving unit for moving the movable plate member, it is possible to incorporate the viscous fluid type heat generator in a heating system so that the heat generating performance is automatically controlled.

It should be appreciated that many further changes or modifications to the described variable heat generating viscous fluid type heat generator will occur to a person skilled in the art without departing from the scope and spirit of the present invention as claimed in the accompanying claims.

We claim:

1. A variable heat generating viscous fluid type heat generator comprising:

a housing assembly having therein a heat generating chamber in which heat is generated, and a heat receiving chamber arranged adjacent to said heat generating chamber to permit a heat exchanging fluid to circulate therethrough to thereby receive heat from said heat generating chambers said heat generating chamber having an inner wall surface thereof;

a drive shaft supported by said housing assembly, via bearing means, to be rotatable about an axis of rotation thereof;

a rotor element mounted to be rotationally driven by said drive shaft for rotation together therewith within said heat generating chamber, said rotor element having an outer face confronting said inner wall surface of said heat generating chamber via a predetermined fluid filled gap;

viscous fluid, filling said predetermined fluid filled gap between said inner wall surface of said heat generating chamber and said outer face of said rotor element, for heat generation during the rotation of said rotor element, wherein said housing assembly defines therein an axially bounded region in which said heat generating chamber is formed to have a given axial width, said housing assembly including a plate member assembly for separating said heat receiving chamber from said heat generating chamber, said inner wall surface of said heat generating chamber being provided to be displaced to adjustably change said axial width of said heat generating chamber.

2. A variable heat generating viscous fluid type heat generator according to claim 1, wherein said plate member assembly comprises at least one axially movable plate member, said axially movable plate member having a face forming a part of said inner wall surface of said heat generating chamber.

3. A variable heat generating viscous fluid type heat generator according to claim 2 wherein said plate member assembly further comprises a fixed plate member for separating said heat receiving chamber from said heat generating chamber, said axially movable plate member defining said heat generating chamber in said axially bounded region.

4. A variable heat generating viscous fluid type heat generator according to claim 2, wherein said heat generator further comprises a moving means for providing said movable plate member with an axial movement to thereby adjustably change said axial width of said heat generating chamber.

5. A variable heat generating viscous fluid type heat generator according to claim 4, wherein said moving means is arranged in a predetermined confined region in which said axially movable plate member axially confronts a stationary part of said housing assembly.

6. A variable heat generating viscous fluid type heat generator according to claim 5, wherein said predetermined confined region is formed as a heat generation control chamber.

7. A variable heat generating viscous fluid type heat generator according to claim 6, wherein said heat generation control chamber is an air-tight chamber, and wherein said moving means comprises:

an elastic element for urging said axially movable plate member in an axial direction for reducing said axial width of said heat generating chamber; and a gas inletting means for introducing a vacuum pressure into said air-tight heat generation control chamber in response to an external control signal, said vacuum pressure acting on said axially movable plate member to produce a force against an elastic force of said elastic element.

8. A variable heat generating viscous fluid type heat generator according to claim 7, wherein said external control signal comprises a temperature detection signal by which the necessity for a supply of heat by said heat-generator is detected.

9. A variable heat generating viscous fluid type heat generator according to claim 6, wherein said moving means comprises:

an elastic element for providing said axially movable plate member with a constant elastic force to move said axially movable plate member in an axial direction for changing said axial width of said heat generating chamber; and a solenoid actuator including a magnetic core element attached to said axially movable plate member, and a solenoid arranged around said magnetic core to attract said core in response to an external control signal to thereby move said axially movable plate member against said constant elastic force of said elastic element.

10. A variable heat generating viscous fluid type heat generator according to claim 9, wherein said external control signal comprises a temperature detection signal by which the necessity for a supply of heat by said heat generator is detected.

11. A variable heat generating viscous fluid type heat generator according to claim 2, wherein said rotor element mounted on said drive shaft is axially fixed to said drive shaft;

wherein said axially movable plate member is elastically urged by an elastic element in an axial direction to reduce said axial width of said heat generating chamber; and wherein at least one of said outer face of said rotor element and said face of said axially movable plate member confronting said outer face of said rotor element comprises a fluid pressure increasing means for increasing a fluid pressure in said fluid filled gap in response to the rotation of said rotor element, to thereby move said axially movable plate member against said constant elastic force of said elastic element in a direction for increasing said axial width of said heat generating chamber.

12. A variable heat generating viscous fluid type heat generator according to claim 11, wherein said fluid pressure increasing means comprises an inclined surface formed in one of said outer face of said rotor element and said confronting face of said axially movable plate member and providing said fluid filled gap between said rotor element and said axially movable plate member with a continuous change in a gap size, in response to the rotation of said rotor element.

13. A variable heat generating viscous fluid type heat generator according to claim 12, wherein said inclined surface is formed in said outer face of said rotor element which is axially attached to said drive shaft to have an angle of inclination with respect to a plane perpendicular to the axis of said drive shaft within a predetermined angular allowance.

14. A variable heat generating viscous fluid type heat generator according to claim 13, wherein said predetermined angular allowance of the inclination is 1 through 5 degrees.

15. A variable heat generating viscous fluid type heat generator according to claim 11, wherein said fluid pressure increasing means comprises recessed portions and elevated portions alternately arranged circumferentially in at least one of said outer face of said rotor element and said confronting face of said axially movable plate member, said recessed and elevated portions being formed to extend in a direction different from a circumferential direction about said drive shaft.

16. A variable heat generating viscous fluid type heat generator according to claim 2, further comprises a limiting means for limiting an axial movement of said axially movable member displaced against a stationary portion of said housing assembly, whereby an adjustable limit of said axial width of said heat generating chamber is determined by said limiting means.

17. A variable heat generating viscous fluid type heat generator according to claim 2, further comprises an urging means for constantly urging said axially movable plate member of said plate member assembly to be moved in an axial direction reducing said axial width of said heat generating chamber, said urging means being arranged in a predetermined confined region in which said axially movable plate member axially confronts a stationary part of said housing assembly.

18. A variable heat generating viscous fluid type heat generator according to claim 17, wherein said urging means comprises a coil spring arranged in said predetermined confined region.

19. A variable heat generating viscous fluid type heat generator according to claim 1, wherein said rotor element mounted on said drive shaft is arranged to be freely movable along the axis of rotation of said drive shaft.

20. A variable heat generating viscous fluid type heat generator according to claim 1, wherein said rotor element mounted on said drive shaft is arranged to be axially fixed to said drive shaft.

21. A variable heat generating viscous fluid type heat generator according to claim 1, wherein said housing assembly has a generally axially extending cylindrical portion to define therein a cylindrical chamber to receive said plate member assembly, said cylindrical chamber having a large open end through which said plate member assembly is assembled therein.

22. A variable heat generating viscous fluid type heat generator according to claim 21, wherein said cylindrical chamber of said housing assembly is sealed against the atmosphere by closing said large open end with a single lid-like housing.

* * * * *